US010546484B2

(12) United States Patent
Caren et al.

(10) Patent No.: US 10,546,484 B2
(45) Date of Patent: Jan. 28, 2020

(54) PERSONAL SAFETY DEVICE

(71) Applicant: RUN ANGEL LIMITED, County Cork (IE)

(72) Inventors: David Caren, Cork (IE); Ellen Caren, Cork (IE); Peter Hill, Fairview (IE); Paddy O'Reilly, County Cork (IE)

(73) Assignee: RUN ANGEL LIMITED, County Cork (IE)

( * ) Notice: Subject to any disclaimer, the term of this patent is extended or adjusted under 35 U.S.C. 154(b) by 38 days.

(21) Appl. No.: 15/763,103

(22) PCT Filed: Sep. 26, 2016

(86) PCT No.: PCT/EP2016/072869
§ 371 (c)(1),
(2) Date: Mar. 24, 2018

(87) PCT Pub. No.: WO2017/051037
PCT Pub. Date: Mar. 30, 2017

(65) Prior Publication Data

US 2018/0276976 A1 Sep. 27, 2018

(30) Foreign Application Priority Data

Sep. 25, 2015 (GB) ..... 1517002.0

(51) Int. Cl.

| | |
|---|---|
| ***G08B 25/01*** | (2006.01) |
| ***G08B 15/00*** | (2006.01) |
| ***G08B 3/10*** | (2006.01) |
| ***H04R 17/00*** | (2006.01) |

(52) U.S. Cl.
CPC ..... *G08B 25/016* (2013.01); *G08B 3/10* (2013.01); *G08B 15/004* (2013.01); *H04R 17/00* (2013.01)

(58) Field of Classification Search
CPC ..... G08B 25/016; G08B 3/10; G08B 15/004; H04R 17/00
USPC ..... 340/539.1, 539.11, 539.13, 539.21, 340/539.23, 573.1, 384.6
See application file for complete search history.

(56) References Cited

U.S. PATENT DOCUMENTS

| | | | | |
|---|---|---|---|---|
| 8,810,426 | B1 * | 8/2014 | Morris | G08B 3/10 116/137 R |
| 2009/0181726 | A1 * | 7/2009 | Vargas | H04M 1/72533 455/567 |
| 2010/0022963 | A1 * | 1/2010 | Edwards | A61M 5/2053 604/197 |
| 2015/0110277 | A1 * | 4/2015 | Pidgeon | H04R 3/00 381/56 |
| 2016/0078858 | A1 * | 3/2016 | Hsieh | G10K 11/172 381/71.7 |

* cited by examiner

*Primary Examiner* — Daryl C Pope

(57) ABSTRACT

Provided is a personal safety-device configured to be attached to, worn by, or carried by a user, comprising: an audible alarm mechanism configured to be selectively activated; a manually activated actuating member for selectively activating the audible alarm mechanism; and an acoustic chamber defining an acoustic cavity for amplifying the audible alarm; wherein the acoustic chamber is housed in the actuating member, wherein the alarm mechanism and the acoustic cavity are configured to have the same resonant frequency.

29 Claims, 10 Drawing Sheets

PERSONAL SAFETY DEVICE

CROSS REFERENCE TO RELATED APPLICATIONS

This application is a 371 US National Stage of PCT Application No. PCT/EP2016/072869, filed on Sep. 26, 2016, which claims the benefit of priority to United Kingdom Application Serial No. 1517002.0, filed Sep. 25, 2015, each of which are incorporated by reference herein in their entirety and for all purposes.

FIELD OF THE INVENTION

This invention relates to personal safety devices and, more specifically, to personal safety devices configured to generate an audible alarm and which can be attached to, worn by or carried by a user.

BACKGROUND OF THE INVENTION

In recent years, more and more people have become involved in health and fitness activities, in particular, within the field of recreational activities such as running, jogging, and walking. Furthermore, much of today's activities are outdoor ones conducted usually during the early morning and late evening when a person is most susceptible to personal attack. Instances of violent acts, specifically against women engaged in lone recreational activity, are on the rise.

Persons may also be at risk of being mugged or assaulted due to the nature of their work e.g., gas station attendants, personnel in shops with late opening hours, night security staff, social workers, estate agents, vulnerable persons such as elderly persons, students, and disabled persons. In addition, in the case of injury or medical emergency—someone may need to attract the attention of a passerby.

There are many personal safety alarm devices and apparatuses currently available. Some of these devices are considered unappealing by those engaged in outdoor sporting activities. For example, some of these devices involve complicated mechanisms for activating an audible alarm, such as the pulling and removal of pins or the holding down of a button for a certain period of time. This can be crucially time consuming for a person being attacked or who may require immediate assistance from injury.

In U.S. Pat. No. 8,624,727, a personal safety device having feature of mobile notification system with geographical tracking capability is disclosed. In U.S. Pat. No. 6,285,289, a wearable personal protection device is disclosed, which incorporates a silent security alarm feature and a smoke detector alarm feature. In U.S. Pat. No. 5,258,746, a personal alarm device, which can be manually actuated to produce a high intensity sound alarm signal, is disclosed.

In U.S. Pat. No. 5,005,002, an alarm device including a deactivation switch physically separated from the activation switch for deactivating the alarm device is disclosed.

There is a need for a personal safety device that produces a high-intensity audible alarm and which has an easy activation means.

SUMMARY OF THE INVENTION

The present disclosure provides a personal safety device as detailed in claim 1. Advantageous features are provided in dependent claims.

The device comprises: an audible alarm mechanism configured to be selectively activated; a manually activated actuating member for selectively activating the audible alarm mechanism; and an acoustic chamber defining an acoustic cavity for amplifying the audible alarm; wherein the acoustic chamber is housed in the actuating member. The alarm mechanism and the acoustic cavity are configured to have the same resonant frequency.

Because the acoustic chamber is housed in the alarm actuating member, the dimensions of the device can be minimised.

The device is capable of producing a loud audible alarm in the range of about 120 dB to about 130 dB, from a simple mechanism when triggered. This acoustic range is in the audible range that is most sensitive to the human ear.

The device may be configured to concentrate the acoustic energy of the alarm output sound in a frequency of about 2.5 kHz to about 5 kHz. This is the frequency range where human hearing is most sensitive to sound. Accordingly, this aspect of the human auditory system has been exploited to optimise the perceived urgency of the triggered alarm sound.

The electrical signal produced by the device may be boosted using a customised autotransformer. The transformer may be configured to be designed in order to consume the minimum amount of battery power to maximise battery life.

The device may comprise both monitoring/tracking and alerting capabilities.

When triggered, the device may be configured to provide, in conjunction with the audible alarm, an emergency notification communicated to pre-determined guardians.

The device may be configured with radio frequency integration to a mobile device such as a smartphone and/or the Internet, which can in turn provide a monitoring and alerting system for the user.

The device may be paired over Bluetooth® or another wireless medium to a mobile device such as a smartphone. A profile of the user may be stored on a mobile application. The profile of the user may comprise contact details of guardians, for example friends, relatives, or next of kin. The device may be configured so that a guardian is notified in the event of alarm activation. The guardian may be notified of an alarm activation in messaging format such as via SMS, email, or social media with details such as time, date, global positioning system (GPS) co-ordinates, and map link which may be displayed in a web browser.

The device may be configured so that emergency services are notified in the event of alarm activation.

The device when activated may be configured to utilise video and sound recording functionality on the mobile device.

A repository of all messaging, signalling, and alerts may be stored on an Internet-based database with a supporting dashboard to gather, monitor, filter and present the data in a unified fashion.

The device may be configured to be worn on various parts of the body e.g. within a wristband or body clasp.

In tuning the acoustic chamber within the device, the dimensions of the device can be minimised, unlike other more cumbersome devices, whilst still producing an audible alarm in the range of about 120 dB to about 130 dB. In this regard, the overall shape and dimensions of the acoustic chamber form part of a resonant circuit that allows the device to generate the high sound pressure levels in the desired frequency region. Out of strap, the device may be about 12 mm in height, 25 mm in width and 40 mm in length.

The device may be configured to be water resistant and to be worn in varying weather conditions.

The alarm, through a mobile application, may be configured to have a delay function which may be customised or personalised in case of a false activation.

Battery life may be observed through LED sequencing, sound alerts from the device or from the mobile application.

The audible alarm and related emergency notifications may be activated remotely from the mobile application interface—forming a two-way communication between the device and application.

The audible alarm may be deactivated also from the mobile application.

The device may also be configured to include a motion sensor, such as an accelerometer, for monitoring steps, distance, sleep habits, etc. In this manner, the device of the present disclosure may be configured to offer both safety and fitness functionality.

BRIEF DESCRIPTIONS OF DRAWINGS

The invention will be more clearly understood by the following description of some embodiments thereof, given by way of example only, with reference to the accompanying drawings, in which.

Figure 13A:
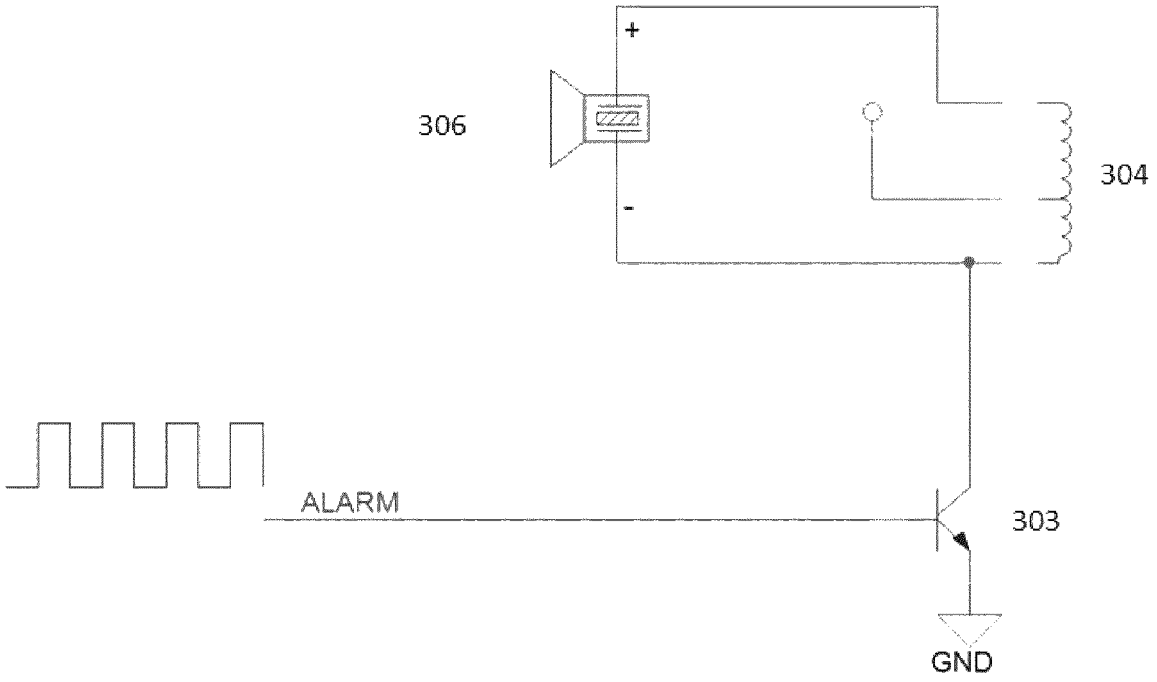
Figure 13B:
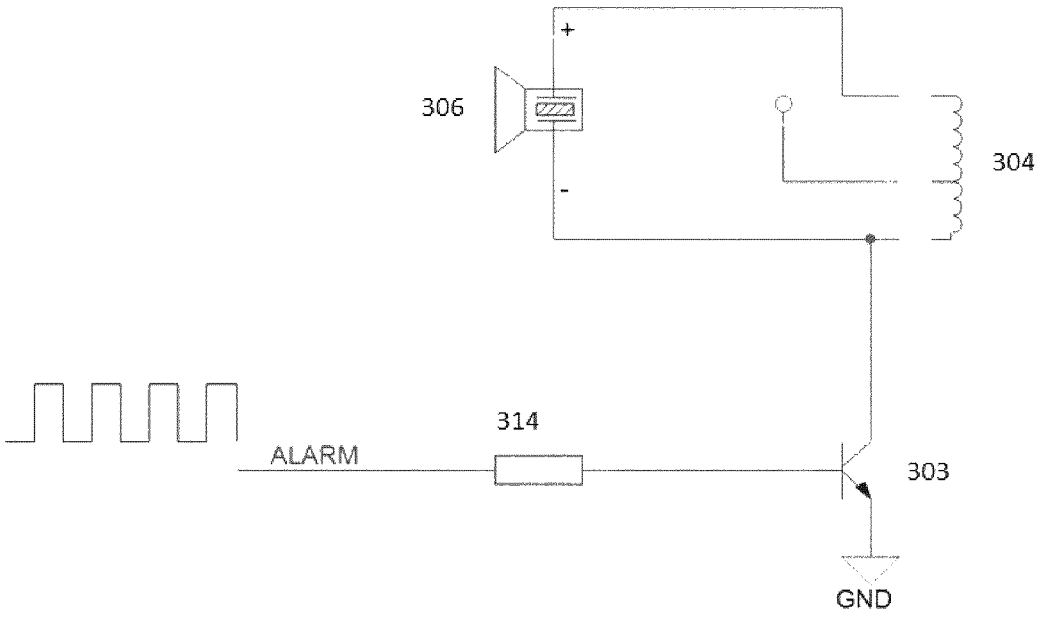
Figure 14:
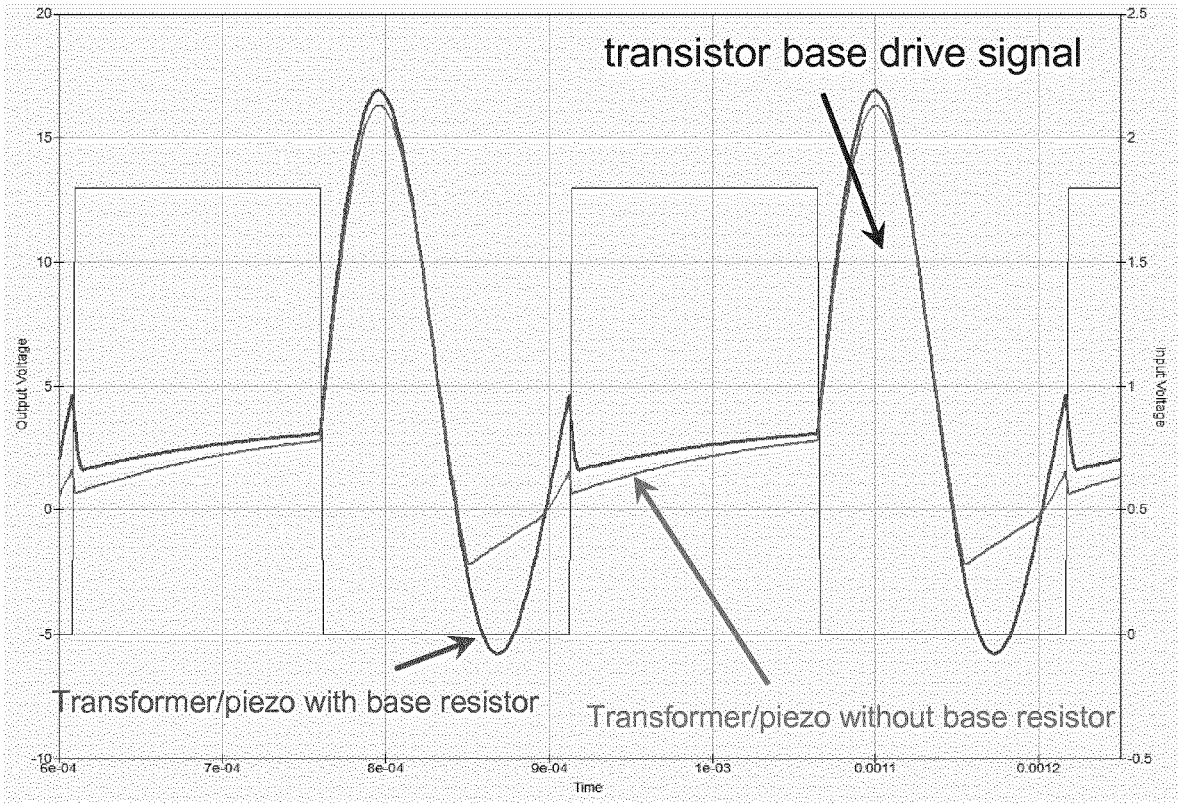
Figure 15A:
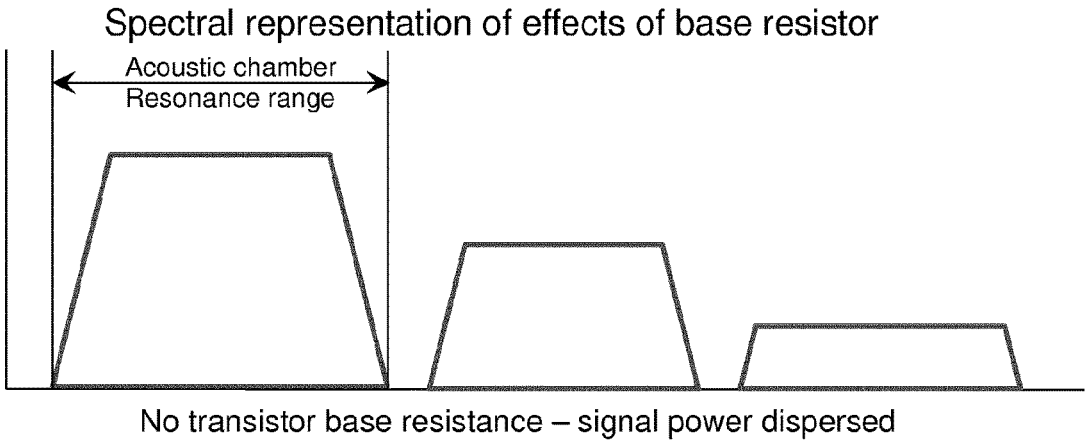
Figure 15B:
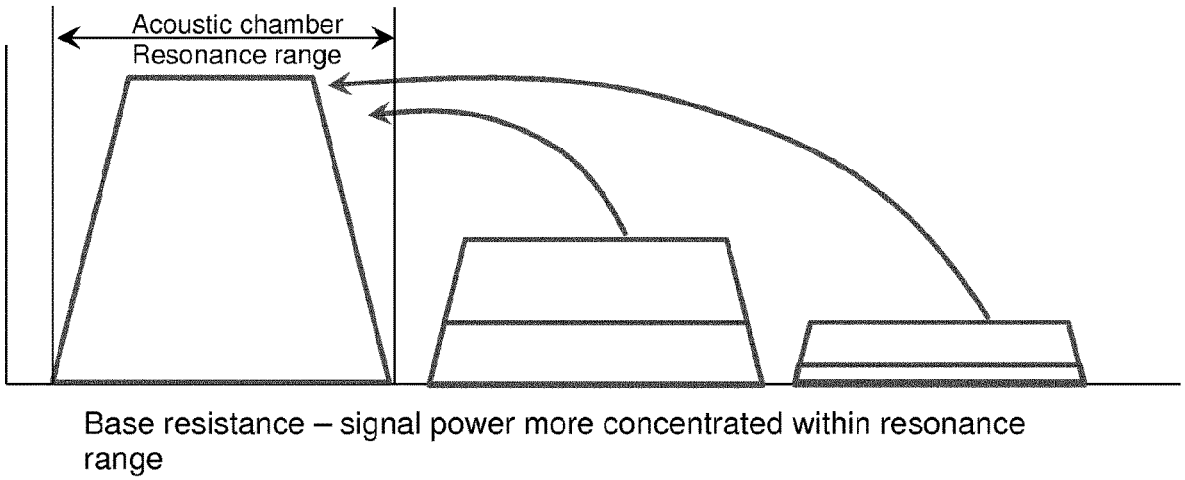

FIGS. 13*a* and 13*b* are circuit schematics illustrating an alarm circuit without and with a base resistor, respectively;

FIG. 14 is a graph illustrating the resulting output signals of the alarm circuits of FIGS. 13*a* and 13*b*; and FIGS. 15*a* and 15*b* illustrate a spectral representation of effects of the base resistor with respect to the alarm circuits of FIGS. 13*a* and 13*b*.

DETAILED DESCRIPTIONS OF THE DRAWINGS

The present disclosure provides a personal safety device that is configured to be attached to, worn by, or carried by a user. The device comprises: an audible alarm mechanism configured to be selectively activated; a manually activated actuating member for selectively activating the audible alarm mechanism; and an acoustic chamber defining an acoustic cavity for amplifying the audible alarm; wherein the acoustic chamber is housed in the actuating member. The alarm mechanism and the acoustic cavity are configured to have the same resonant frequency. The alarm mechanism comprises an alarm circuit which drives an audio transducer mounted within the acoustic chamber. The transducer may be a piezoelectric transducer.

The personal safety device is configured to be attached to, worn by, or carried by a user. The device may comprise an attachment means for attachment to a user. For example, the personal safety device may be configured to be a worn by a user. In this regard, the device may be configured to be fitted within a wristband or a strap, i.e., to be configured as a wearable device.

Figure 1:
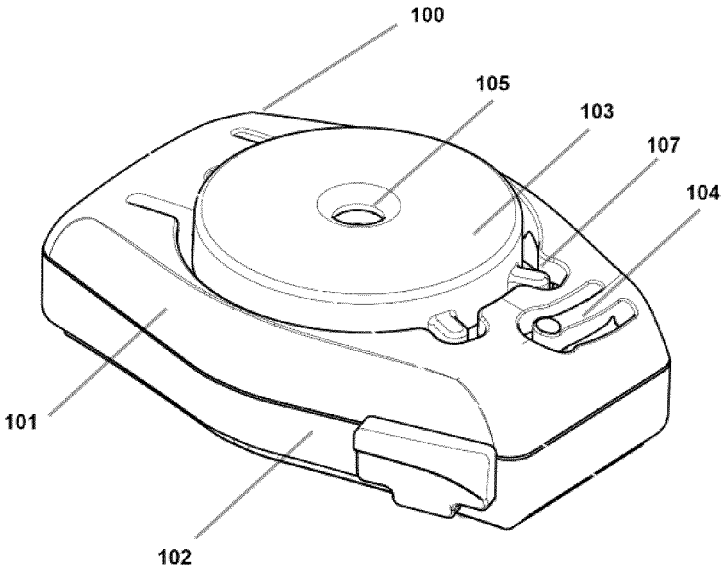
FIG. 1 is a perspective view of a personal safety device according to an embodiment of the present disclosure.

FIG. 1 is a perspective view of a personal safety device 100 according to an embodiment of the present disclosure. Referring to FIG. 1, the device 100 has a housing comprising a top housing section 101 and a bottom housing section 102. The top housing section 101 and the bottom housing section 102 are configured to be attached to each other. The top housing section 101 and the bottom housing section 102 are configured to accommodate constituent components of the device 100. Each of the top housing section 101 and the bottom housing section 102 may be formed of a suitable plastic, but the present teaching is not limited thereto and may be made of other suitable materials as well. The top housing section 101 comprises an alarm actuating member 103 which houses an acoustic chamber. The acoustic chamber is configured to amplify a sound alarm generated by the alarm mechanism. The acoustic chamber 103 also functions as an alarm actuating member of the device 100. Referring to FIG. 1, the alarm actuating member 103 may have a cylindrical shape. The alarm actuating member 103 is configured to be moveable in relation to the rest of the top housing section 101. The alarm actuating member 103 is configured to be depressed into the top housing section 101, thereby activating the alarm circuit. In emergency situations, a person wearing the personal safety device 100 can activate the alarm by pressing on the alarm actuating member 103. Referring to FIG. 1, the alarm actuating member 103 has a sound output aperture 105 disposed in a central portion thereof. The alarm actuating member 103 may also comprise one or more trigger contacts 107 for activating the alarm circuit provided within the housing. The trigger contacts 107 may protrude from a sidewall of the alarm actuating member 103. The device 100 also may comprise an on/off switch or button 104.

Figure 2:
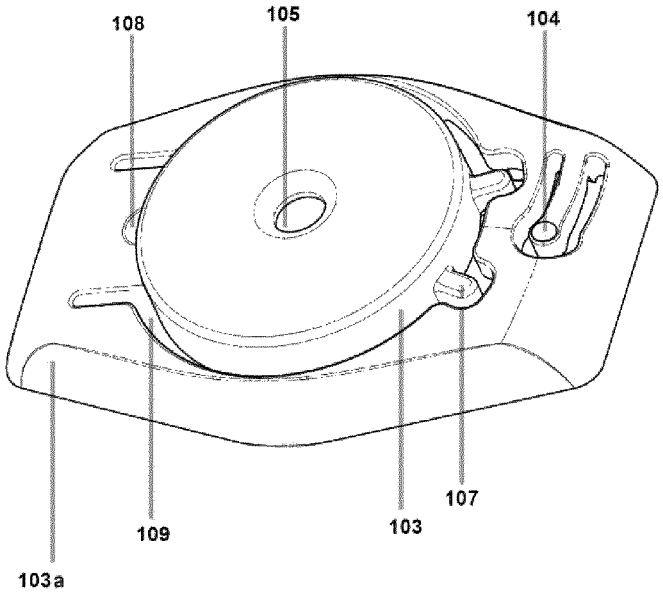
FIG. 2 illustrates a top housing section of the device of FIG. 1, according to an embodiment of the present disclosure.

FIG. 2 illustrates the top housing section 101 of the device 100, according to an embodiment of the present disclosure. The top housing section 101 is constructed to house the acoustic chamber for amplifying the sound alarm. Referring to FIG. 2, the top housing section 101 comprises a main top housing section 103*a* and the alarm actuating member 103. The alarm actuating member 103 may protrude from a top recessed portion 109 of the main housing chamber 103*a*. Thus, the main top housing section 103*a* and the alarm actuating member 103 together define a space bordered by the inner surfaces thereof. The alarm actuating member 103 may protrude from the top recessed portion 109 of the main top housing section 103*a*. In this manner the alarm actuating member 103 can serve as an activation member of the device 100. As shown in FIG. 2, the alarm actuating member 103 may protrude from the top recessed portion 109 of the main top housing section 103*a*. The alarm actuating member 103 is configured to be moveable in relation to the main top housing section 103*a*. The alarm actuating member 103 is configured to be depressed downwards into the main top housing section 103*a*, thereby activating the alarm circuit. Thus, the alarm actuating member 103 is moveable within the top recessed portion 109. In more detail, the alarm actuating member 103 may be hinged with the main top housing section 103*a* at one side thereof. This enables the alarm actuating member 103 to be tilted downwards at an angle and enable the trigger contacts 107 to activate the alarm circuit. When the alarm actuating member 103 is depressed downwards into the main top housing section 103*a*, the alarm actuating member 103 tilts downward at an angle in relation to the main top housing section 103*a*. The sound output aperture 105 may be defined in a roof of the acoustic chamber 103. The edges of the sound output aperture 105 may be convex in design to permit omnidirectional propagation of sound. The alarm actuating member 103 may protrude from the top recessed portion 109 of the main housing chamber 103*a* to allow a user to activate the device 100 by simply pressing the alarm actuating member 103. When the alarm actuating member 103 is pressed, an alarm is activated. The alarm is an audible sound alarm. When the device is activated to trigger the alarm, the device may also be configured to communicate with a user's smartphone through a mobile application. The communication may entail sending message alert to one or more contacts or guardians. Such communication will be described later.

Referring to FIG. 2, the main housing chamber 103*a* may define a light conduit 108 in the top surface thereof for allowing passage of light from a light source contained within the housing. The light source may be a light-emitting diode (LED) mounted on a printed circuit board (PCB) 112, illustrated in FIG. 5, contained within the housing. The light conduit 108 may be provided adjacent to the acoustic chamber 103. The light conduit 108 may be disposed on an opposite side of the acoustic chamber 103 to the trigger contacts 107. Various LED colour sequencing may be used to indicate a state of the device 100. The state of the device 100 may comprise at least one of a battery power status, SOS LED alert and a pairing status for communicating with a mobile device such as a smartphone. When fitted into a carrier or clasp such as a silicone wristband, light shines up the light conduit 108 in the housing through the carrier or clasp.

When the alarm actuating member 103 is pressed, it makes contact with switches on the printed circuit board 112 which trigger the alarm. The device 100 may be deactivated or turned off by pressing on the on/off switch 104. The device 100 may be deactivated remotely from a mobile application. In addition, the audible alarm may be independently deactivated from the mobile application without it hindering alert messages being sent.

Figure 3:
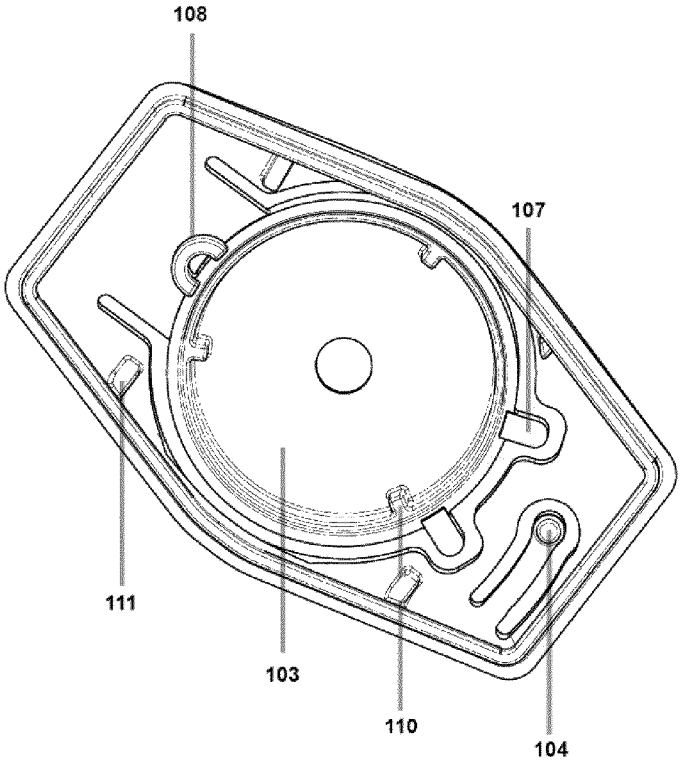
FIG. 3 illustrates an underside of the top housing section of the device of FIG. 1, according to an embodiment of the present disclosure.
Figure 5:
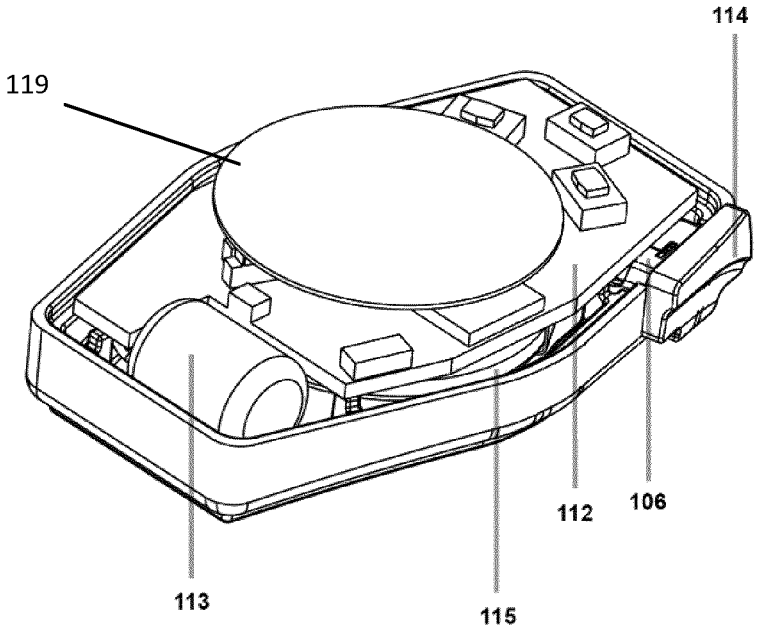
FIG. 5 illustrates a printed circuit board disposed above other components housed in the bottom housing section of the device, according to an embodiment of the present disclosure.

FIG. 3 illustrates an underside of the top housing section 101 of the device of FIG. 1, according to an embodiment of the present disclosure. The top housing section 101 is configured to house an audio transducer. In one embodiment, a piezoelectric transducer 119, as illustrated in FIG. 5, is fitted within the acoustic chamber housed in the alarm actuating member 103 in the top housing section 101. The piezoelectric transducer 119 may be sealed within the acoustic chamber. Referring to FIG. 3, the top housing section 101 may comprise protrusions 110 projecting from an inner wall of the acoustic chamber. The protrusions 110 help to secure the piezoelectric transducer 119 in place, and ensure the necessary distance from the sound output aperture 105 for maximum sound pressure. The piezoelectric transducer 119 may be a standard piezo element. In this regard, a piezoelectric transducer 119 with a self-resonant frequency of 3.6 kHz may be used. Amplification of the sound alarm is provided by a resonance effect of the piezoelectric transducer 119 with the acoustic chamber. The structure of the acoustic chamber and the resonance effect are described below.

The trigger contacts 107 may be provided on the outer sidewall of the alarm actuating member 103. The trigger contacts 107 may be configured to connect with contact switches on the printed circuit board 112 to activate the device 100. Referring to FIG. 3, rib features 111 on an inner wall of the top housing section 101 are configured to prevent the printed circuit board 112 from moving within the housing of the device 100.

The light conduit 108 disposed adjacent to the alarm actuating member 103 emits light from an LED on the printed circuit board 112 through a small opening in the top housing section 101.

Figure 4:
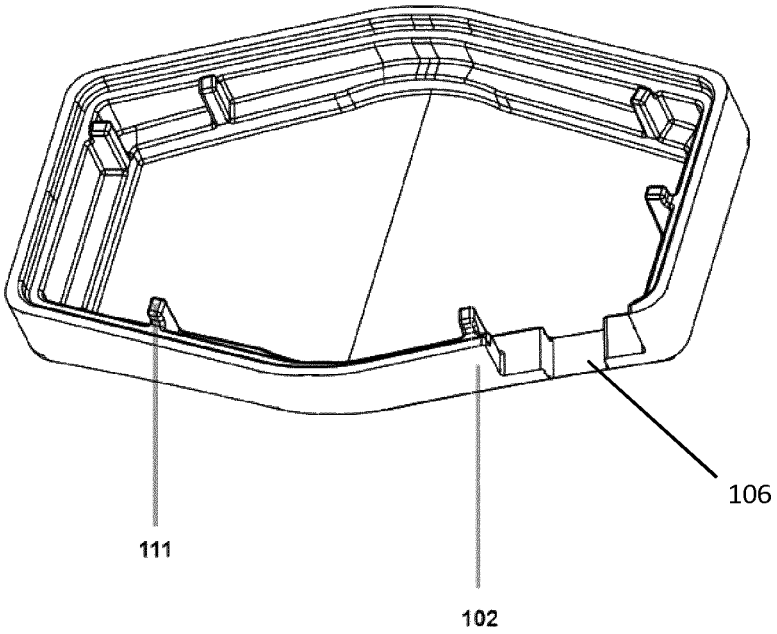
FIG. 4 illustrates a bottom housing section of the device of FIG. 1, according to an embodiment of the present disclosure.

FIG. 4 illustrates the bottom housing section 102 of the device 100 of FIG. 1, according to an embodiment of the present disclosure. Referring to FIG. 4, the bottom housing section 102 defines rib features 111 on an inner wall thereof. The rib features 111 are configured to allow the printed circuit board 112 to sit securely in the bottom housing section 102 without any movement. The rib features 111 also provide the added benefit of suspending the printed circuit board 112, thus allowing sufficient space for a rechargeable battery 115 to be accommodated. The rechargeable battery 115 may be connected to the underside of the printed circuit board 112.

The inner walls at the top of the bottom housing section 102 may be recessed to connect and seal with the top housing section 101. The bottom housing section 102 may define an opening in a sidewall thereof to accommodate a USB port 106.

FIG. 5 illustrates the printed circuit board 112 disposed above other components housed in the bottom housing section 102 of the device 100, according to an embodiment of the present disclosure. Referring to FIG. 5, the printed circuit board 112 with other components may be held in place with rib features (not shown). Such components may include a Bluetooth® chip set, an accelerometer, the rechargeable battery 115 and the USB port 106. The printed circuit board 112 may be configured to be received in the top housing section 101 to allow sufficient space below the printed circuit board 112 for the rechargeable battery 115 and other components to be accommodated. The piezoelectric transducer 119 is also illustrated in FIG. 5.

Figure 6:
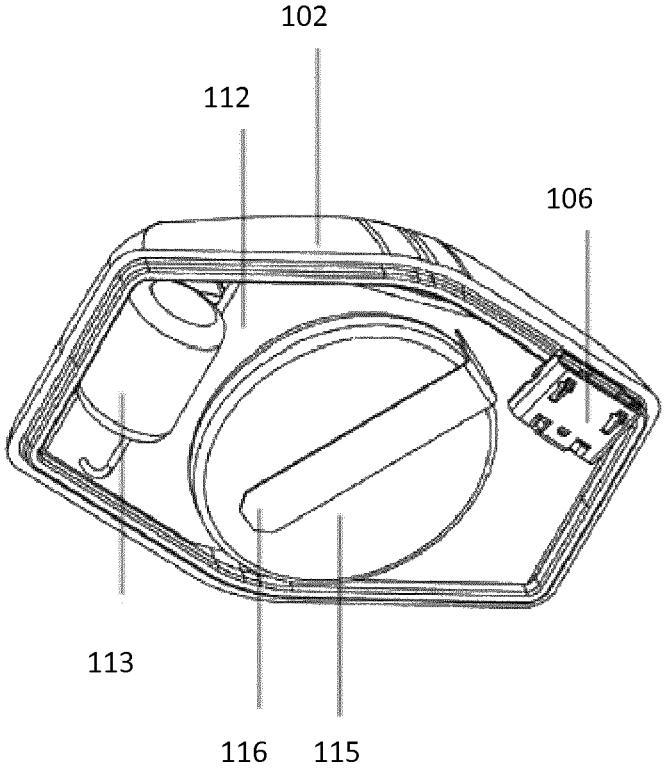
FIG. 6 illustrates an underside view of the printed circuit board with the top housing section, according to an embodiment of the present disclosure.

FIG. 6 illustrates an underside view of the printed circuit board 112 within the top housing section 101, according to an embodiment of the present disclosure. Referring to FIG. 6, the rechargeable battery 115 and tabs 116 may be configured to be connected to the underside of the printed circuit board 112. To power the rechargeable battery 115 a USB connector may be inserted into the USB port 106 at the side of the printed circuit board 112. The USB port 106 protrudes from an opening in the outer wall of the bottom housing section 102 so as to mate with a USB connector. A customised autotransformer 113 may be connected to the printed circuit board 112 and disposed to a side thereof. A signal from the alarm circuit may be boosted using the customised autotransformer 113. The customised autotransformer 113 may be configured to consume a minimum amount of power to conserve battery life.

Figure 7:
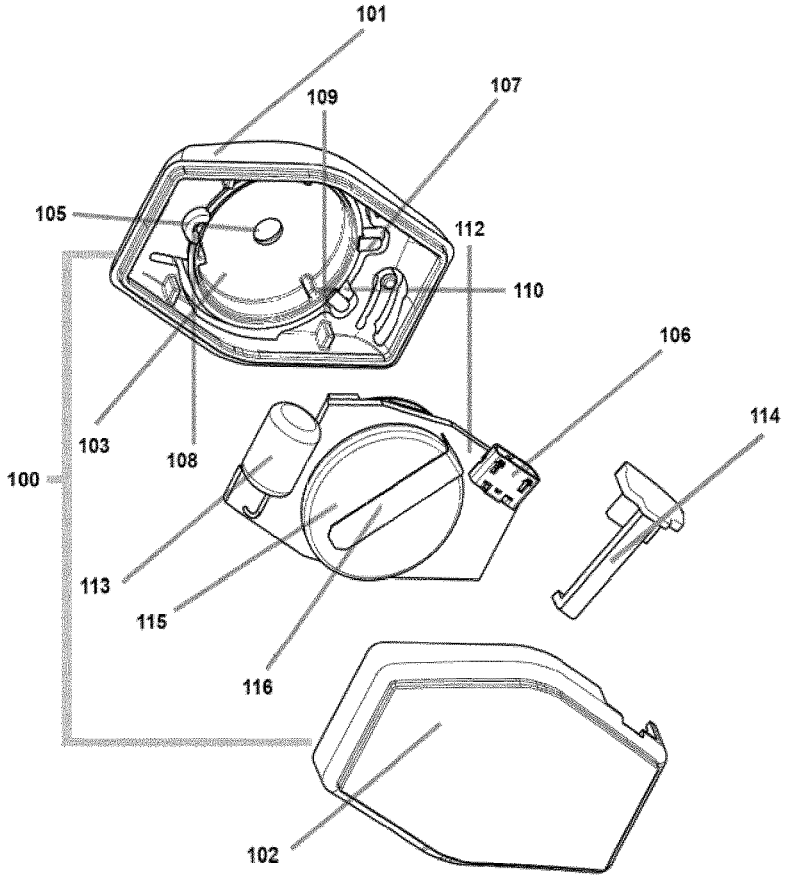
FIG. 7 and FIG. 8 are exploded views of the personal safety device, showing the main components thereof, according to an embodiment of the present disclosure.
Figure 8:
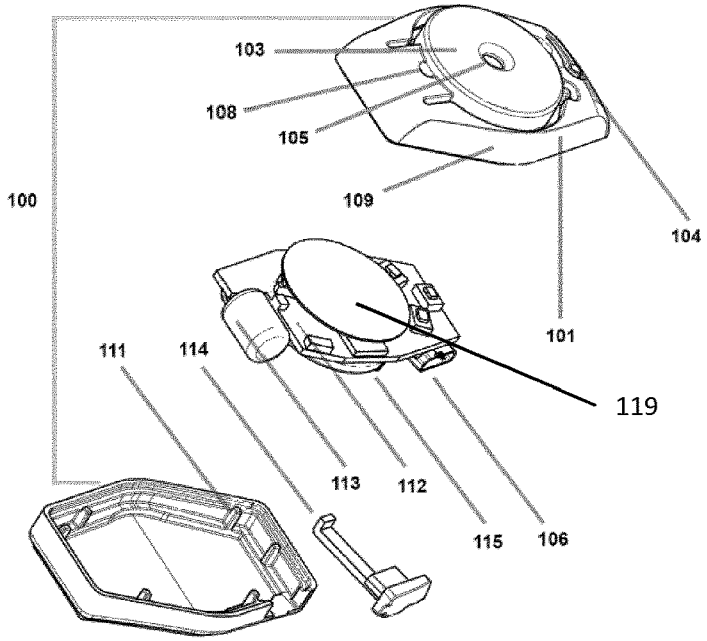

FIG. 7 and FIG. 8 are exploded perspective views of the device 100, showing the main components thereof, according to an embodiment of the present disclosure. Referring to FIG. 7, a USB plug 114 may be provided to protect the USB port 106 from any water/particle ingress entering the housing and allows the user to insert a USB connector into the side of the housing powering the device by its rechargeable battery 115. However, in other embodiments, for example as illustrated in FIG. 4, a USB plug is not provided over the USB port 106.

Figure 9:
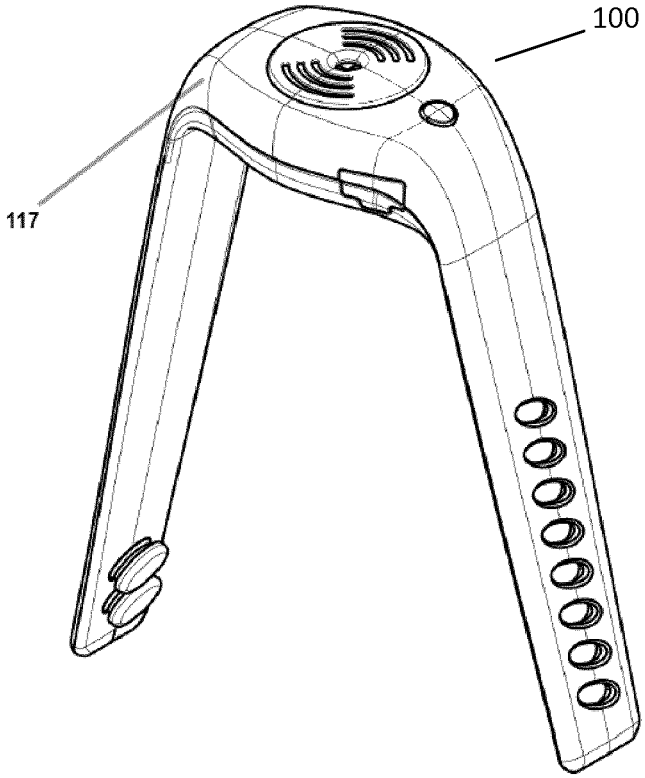
FIG. 9 illustrates a fully assembled personal safety device fitted within a wrist strap, according to an embodiment of the present disclosure.

FIG. 9 illustrates a fully assembled personal safety device 100 fitted within a wrist strap 117, according to an embodiment of the present disclosure. It will be understood by the skilled person that the device 100 illustrated in FIGS. 1 to 8 may be fitted within the wrist strap 117. Out of strap, the device 100 may be about 12 mm in height, 25 mm in width and 40 mm in length.

The alarm mechanism will now be described, according to an embodiment of the present disclosure. The alarm mechanism comprises an alarm circuit and an audio transducer, wherein the alarm circuit is configured to drive the audio transducer. A microcontroller on the printed circuit board 112 monitors the state of the switches on the printed circuit board 112. The trigger contacts 107 on the outer sidewall of the alarm actuating member 103 are configured to make contact with the switches on the printed circuit board 112. When the "Alarm On" switch is activated, the alarm circuit may produce an oscillating electrical signal. The electrical signal is then input to the autotransformer 113 through the primary side of an autotransformer 113 and boosted through the secondary winding. The boosted electrical signal is then applied to the piezoelectric transducer 119. The piezoelectric transducer 119 is connected to the autotransformer 113. The boosted electrical signal drives the piezoelectric transducer 119 forcing the attached diaphragm to vibrate resulting in a high-intensity sound signal.

The microcontroller may be configured to communicate with a Bluetooth®-enabled mobile device, such as a smartphone, tablet, or the like, which is configured to connect with it. On an alarm condition, the device may instruct the mobile application to send text and email alert messages to a number of guardians pre-defined in the mobile device.

The alarm may be turned off by pressing the on/off switch 104 and the microcontroller detects this condition and stops the pulse stream to the autotransformer 113.

As described above, the electrical signal activated by the "Alarm On" switch may be boosted using the autotransformer 113. The autotransformer 113 may be customised according to the requirements of the device 100. The autotransformer 113 may be configured to consume a minimum amount of power to conserve battery life. The customised autotransformer 113 may be securely fastened to one side of the printed circuit board 112 and may be positioned midway between the top housing section 101 and bottom housing section 102.

In one embodiment, the autotransformer 113 may be a standard DR 6×8 core with three pins. The primary side may have about 250 turns and the secondary side may have about 1280 turns. The wire diameter may be about 0.05 mm. It will be understood that the primary-secondary turns ratio and wire diameter may be configured to arrive at an optimum configuration for the output sound level and power consumption. As described above, the alarm mechanism and the acoustic cavity are configured to have the same resonant frequency. That is, the alarm mechanism comprising the piezoelectric transducer/autotransformer combination and the acoustic cavity are configured to have the same resonant frequency. In this regard, each of the piezoelectric transducer/autotransformer combination and the acoustic cavity may have a resonant frequency in the range of about 2.5 kHz to about 5 kHz. The dimensions and shape of the acoustic cavity may be configured so that the acoustic cavity has a resonant frequency in the range of about 2.5 kHz to about 5 kHz.

The sound signal output from the piezoelectric transducer is amplified in the acoustic chamber defined by the alarm actuating member 103. As mentioned above, the overall shape and dimensions (height to diameter ratio) of the acoustic chamber form part of the resonant system that allows the device to generate the high sound pressure levels in the desired frequency region.

Figure 10:
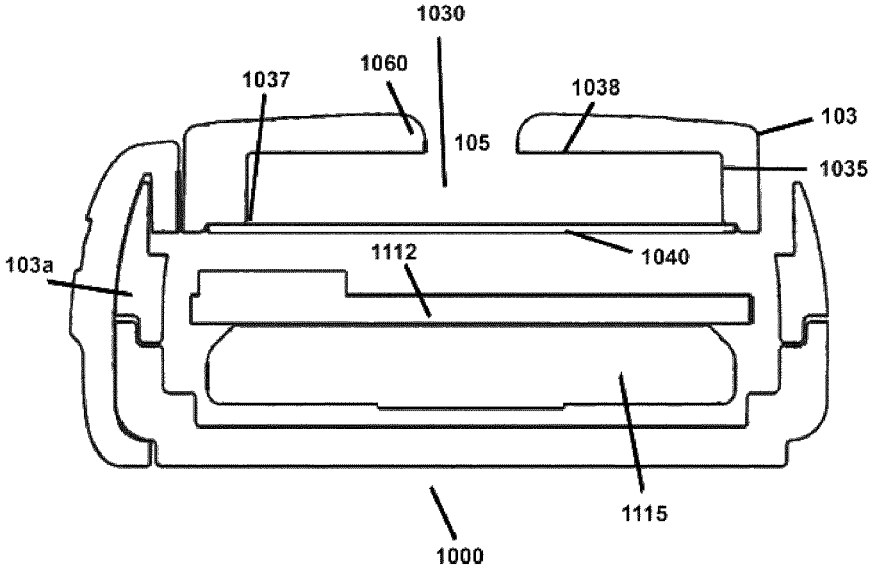
FIG. 10 is a cross-sectional diagram of a personal safety device including an acoustic chamber housed in the alarm actuating member, according to an embodiment of the present disclosure.

FIG. 10 is a cross-sectional diagram of a personal safety device 1000 including an acoustic chamber 1030 defined by the alarm actuating member 103, according to an embodiment of the present disclosure. The alarm actuating member 103 may be circular in shape. Referring to FIG. 10, a rebate 1050 may be defined in an inner sidewall of the alarm actuating member 103 for secure and precise location of a piezoelectric transducer 1040 during assembly. The piezoelectric transducer 1040 may be fitted into the acoustic chamber 1030 forming an airtight seal between the periphery of the piezoelectric transducer 1040 and inner sidewalls 1037 of the acoustic chamber 1030. In this regard, circumferential edges of the piezoelectric transducer 1040 may be attached to the inner sidewalls 1037 of the acoustic chamber 1030 by adhesive or another means.

The piezoelectric transducer 1040 may be disk-shaped with a diameter of approximately 20 mm. The arrangement of the piezoelectric transducer 1040 mounted within the acoustic chamber 1030 and the sidewalls 1037 and a roof 1038 of the acoustic chamber 1030 together define an acoustic cavity 1035. The overall shape and dimensions (height to diameter ratio) of the acoustic cavity 1035 form part of the resonant system that allows the device 1000 to generate the high sound pressure levels in the desired frequency region. As mentioned above, the dimensions and shape of the acoustic cavity may be configured so that the acoustic cavity has a resonant frequency in the range of about 2.5 kHz to about 5 kHz. In this regard, the acoustic cavity 1035 may be configured to have a cylindrical shape. The piezoelectric transducer 1040 may be positively located in the acoustic chamber 1030 using a shoulder structure whereby the inner diameter of the acoustic chamber 1030 is slightly smaller than that of the piezoelectric transducer 1040. Accordingly, in one embodiment, the acoustic cavity 1035 may have a diameter slightly less than about 20 mm. The acoustic cavity 1035 may have a depth of about 3 mm. The acoustic chamber 1030 is closed at a bottom end by the piezoelectric transducer 1040, and open at a top end thereof by virtue of an aperture defined in the roof 1038. Because the piezoelectric transducer 1040 has a diameter greater than the inner diameter of the acoustic chamber 1030, the piezoelectric transducer 1040 can be secured at the base of the inner sidewalls 1037 of the acoustic chamber 1030.

The sound output aperture 105 comprises an opening in the roof 1038 of the acoustic chamber 1030. It will be understood that the sound output aperture 105 is therefore defined in a roof of the alarm actuating member 103. The sound output aperture 105 may be circular in shape and may have a diameter of about 3 mm. The sound output aperture 105 may be disposed in a central portion of the alarm actuating member 103.

As mentioned above, edges of the sound output aperture 105 may be convex in shape to permit omnidirectional propagation of sound. More particularly, a chamfer 1060 on the outer edge of the sound output aperture 105 also forms part of the resonant system improving the acoustic coupling of the acoustic cavity to the outside world.

The piezoelectric transducer 1040 acts as a dipole acoustic source. The sound energy from the rear of the piezoelectric transducer 1040 is enclosed within the body of the device 1000. Further, the device 1000 may be sealed within a strap enclosure, and thus the sound energy from the rear of the piezoelectric transducer 1040 is prevented from discharging into free space by the strap enclosure.

Referring again to FIG. 10, the alarm actuating member 103 may be hinged with the main top housing section 103*a* to allow the alarm actuating member 103 to be depressed into the housing. The alarm actuating member 103 may be hinged with the main top housing section 103*a* on one side, depicted in FIG. 10 on the left side of the device.

This configuration allows the right side of the alarm actuating member 103 to be tilted downwards into the housing. In this arrangement, it will be understood that the alarm actuating member 103 is biased to an alarm OFF condition. FIG. 10 also illustrates a PCB 1112 and a battery 1115.

As described above, the alarm circuit, which includes custom designed components, may be configured and tuned in conjunction with the piezoelectric transducer 1040 and acoustic chamber 1030 to maximise the output sound level in the desired frequency range with the minimum power consumption. This optimisation allows the length of time the device 1000 can be operated in alarm mode to be maximised.

The output signal comprises a frequency modulated single tone. This creates a characteristic and psychoacoustically distinctive, wailing siren sound designed to be instantly recognisable as an alarm signal and attract attention.

In addition to modulating the output signal, the device concentrates the acoustic energy of the output sound in a range of about 2.5 kHz to about 5 kHz. This is the frequency range where human hearing is most sensitive to sound level and this aspect of the human auditory system has been exploited to optimise the perceived urgency of the triggered alarm sound.

The status of the device may be visually indicated using coloured status LEDs. The conditions may include, but are not limited to, "Alarm condition", "Communicating with Bluetooth® device", "SOS warning", "Battery low" and "Charging".

Charging the device may be undertaken by connecting to a USB charger or computer using a USB connector.

Figure 11:
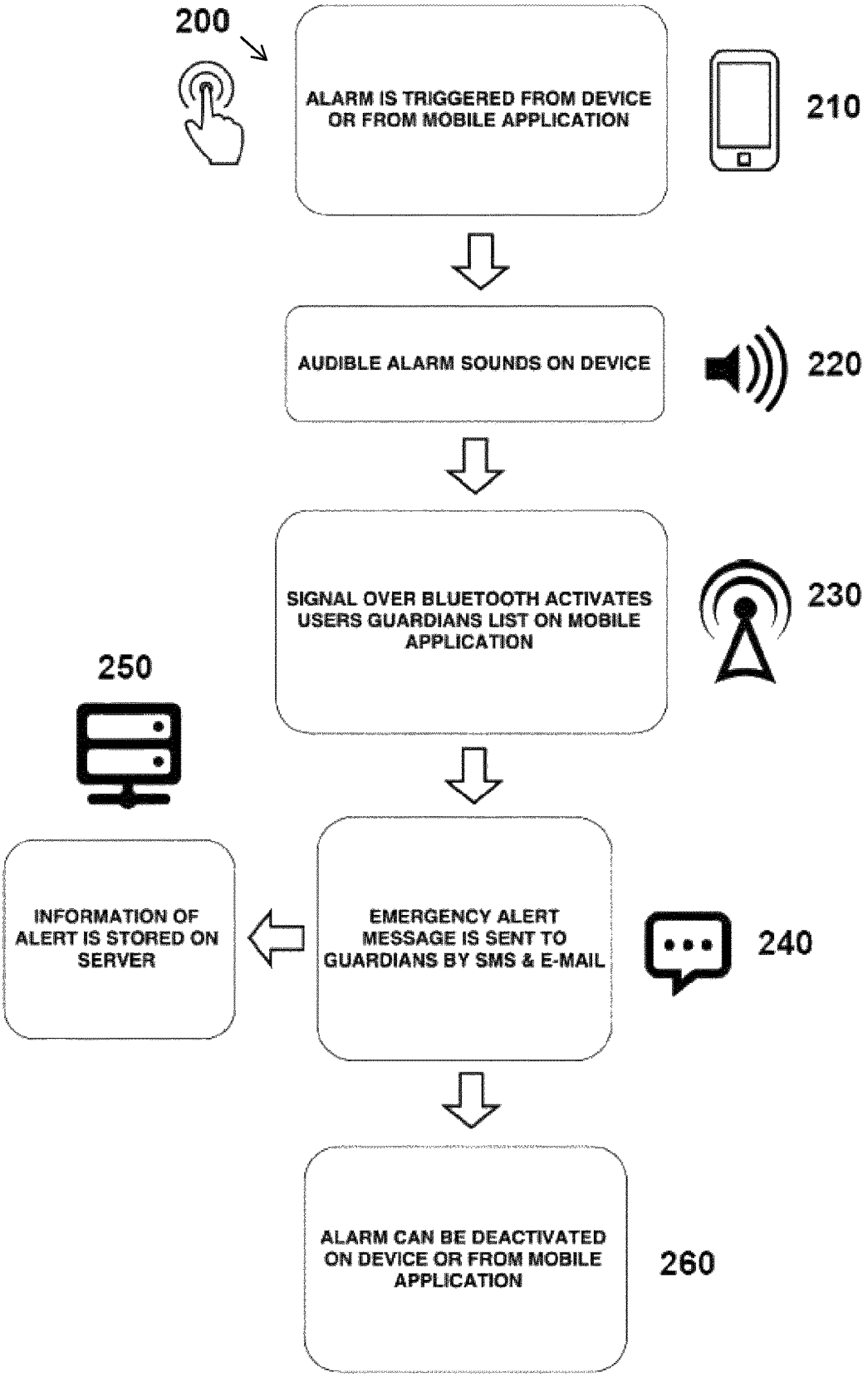
FIG. 11 is a flowchart showing a sequence of events of how the device is activated and operated, according to an embodiment of the present disclosure.

FIG. 11 is a flowchart 200 showing a sequence of events of how the device is activated and operated, according to an embodiment of the present disclosure. First of all, the user activates or triggers the device by a single press down of the alarm actuating member located in the centre of the top housing section of the device 210. The alarm mechanism may also be triggered remotely from a mobile application. Then, the trigger contacts on the outer sidewall of the alarm actuating member make contact with switches on the printed circuit board to activate an audible alarm sound in the range of about 120 dB to about 130 dB and sounding in the frequency range where human hearing is most sensitive 220. Simultaneously or subsequently, activation of the device may also cause a signal to be wirelessly transmitted to a user's mobile device such as a smartphone 230. The signal received by the user's mobile device may cause a mobile application installed on the mobile device to be automatically initialised. The mobile application may activate the user's pre-configured contacts or guardians sending an emergency alert message comprising a distress notification 240. The emergency alert message may include a time and date stamp and GPS coordinates. A time delay function may be incorporated into the mobile application to prevent accidental activation. Emergency alert information messages may be logged and stored on a secure server with a supporting dashboard, which gathers, monitors, filters and presents data in a user-friendly manner 250. Deactivation or switching off of the audible alarm may be achieved by a single press down of the raised on/off switch on the device or cancelled through the mobile application 260. The device may be configured to be triggered and related emergency notifications may be activated remotely from the mobile application interface—forming a two-way communication between the device and application. The device may be deactivated remotely from a mobile application. In addition, the audible alarm may be independently deactivated from the mobile application without it hindering alert messages being sent.

Figure 12:
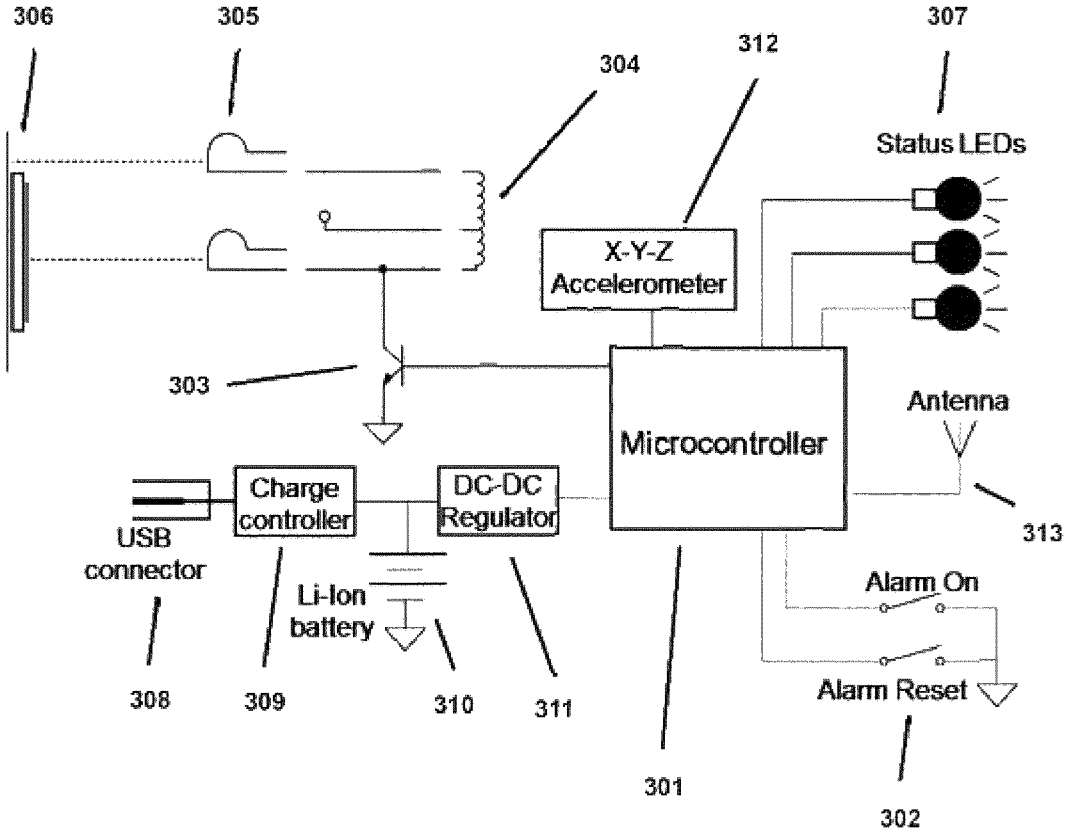
FIG. 12 is a circuit diagram illustrating operation of the alarm mechanism, according to an embodiment of the present disclosure.

FIG. 12 is a circuit diagram illustrating operation of the alarm mechanism, according to an embodiment of the present disclosure. The alarm mechanism comprises an alarm circuit and an audio transducer such as a piezoelectric transducer, wherein the alarm circuit is configured to drive the piezoelectric transducer. Referring to FIG. 12, the device according to the present embodiment includes one or more of a microcontroller 301, alarm switches 302, a driver transistor 303, a customised autotransformer 304, spring contacts 305, a piezoelectric transducer 306, coloured status LEDs 307, a USB connector 308, a charge controller 309, a lithium-ion rechargeable battery 310, a step-down DC-DC converter 311, an accelerometer 312, and a Bluetooth® antenna 313.

The microcontroller 301 monitors the state of the alarm switches 302. If the "Alarm On" switch 302 is activated, a series of frequency modulated pulses are generated by the microcontroller 301 and sent to the driver transistor 303. The driver transistor 303 may be a NPN BJT transistor. The driver transistor 303 may switch current through the primary side of the autotransformer 304 which is amplified through the secondary winding and applied to the piezoelectric transducer 306. The piezoelectric transducer 306 may be connected to the autotransformer 304 using spring contacts 305 in order to facilitate low cost, reliable manufacturing processes. The microcontroller 301 may communicate with a Bluetooth®-enabled mobile device which is configured to connect with it. On an alarm condition, the personal safety device instructs the mobile device to send text and email alert messages to a number of guardians pre-defined in the mobile device. The alarm may be turned off by pressing the "Alarm Reset" switch 302 and the microcontroller 301 detects this condition and stops the pulse stream to the driver transistor 303. The resulting sound is amplified using the acoustic chamber detailed above.

As described above, the alarm circuit may be configured and tuned in conjunction with the piezoelectric transducer and acoustic cavity to maximise the output sound level in the desired frequency range with the minimum power consumption. Amplification of the sound alarm is provided by a resonance effect of the piezoelectric transducer/autotransformer combination with the acoustic chamber. FIGS. 13*a* and 13*b* are circuit schematics illustrating an alarm circuit without and with a base resistor, respectively.

The autotransformer and piezoelectric transducer form a typical electronic tuned circuit commonly known as an LC (inductor-capacitor) circuit. An LC circuit resonates much like a guitar string. Referring to FIG. 12, the autotransformer 304 is configured to operate with the piezoelectric transducer 306 to resonate in the range of interest of the system (about 2.5 kHz to about 5 kHz). Using the analogy of a guitar string, the energy put into plucking the guitar string is stored in the elasticity of the string and released as acoustic energy (sound). The energy stored in the autotransformer 304/piezoelectric transducer 306 combination generates a resonant sinusoidal voltage signal across the piezoelectric transducer 306 causing mechanical vibrations of the piezoelectric transducer 306 which in turn produces audible sound. The resonance therefore occurs at the frequency of highest efficiency for the system.

The combination of the autotransformer 304 and the piezoelectric transducer 306 effectively form a tuned inductor-capacitor (LC) circuit allowing the current flowing into these components to be stored. The fundamental frequency of operation is defined by:

$$f = \frac{1}{2\pi\sqrt{L \cdot C}}$$

where:—

L=autotransformer inductance

C=piezoelectric transducer capacitance

The autotransformer 304 may be configured to have a total inductance of 65 mH±10%. The specific number of turns combined with the wire diameter and core dimensions, examples of which are provided above, may be chosen to provide this inductance. The piezoelectric transducer 306 may be configured to have a capacitance of 28 nF±10%. In one embodiment, this combination may result in a resonant frequency of:

$$f = \frac{1}{2\pi\sqrt{0.065 \times 28e-9}} = 3730 \text{ Hz}$$

which is the centre of the frequency range generated by the microcontroller 301.

The driver transistor 303 may be driven by a driving signal output from a current source via the microcontroller 301. The driving signal may be in the form of a square wave. The driving signal from the microcontroller 301 may be optimised to be in the desired frequency range to match and achieve the desired output frequency. During the positive or 'ON' part of the driving signal cycle, current flows through the driver transistor 303 into the autotransformer 304, the result being energy stored in the inductance of the autotransformer 304. During the 'OFF' cycle, current flows from the autotransformer 304 to the piezoelectric transducer 306. The reactive properties of the autotransformer 304 in parallel with the piezoelectric transducer 306 result in almost the full energy stored in the autotransformer 304 being transferred to the capacitance of the piezoelectric transducer 306 in simple harmonic motion (i.e. sine wave form). Due to the resonant nature of the system, the charge stored in the capacitance of the piezoelectric transducer 306 reaches a maximum and begins to flow back into the autotransformer 304 again in simple harmonic motion. When the voltage across the autotransformer 304/piezoelectric transducer 306 combination reaches −0.7 V, the driver transistor 303 begins to conduct through the collector-base junction and all the energy is lost into the virtual ground of the microcontroller 301.

When the driving signal switches off, the LC circuit formed by the autotransformer 304 and the piezoelectric transducer 306 is allowed to oscillate at its resonant frequency. The resonant frequency of the autotransformer 304 and the piezoelectric transducer 306 and the rate of discharge of the stored energy may be optimised to prevent harmonic distortion and further maximise the energy in the desired frequency range. The choice of components around the driver transistor 303 allow the circuit to produce a maximum voltage amplitude, thus maximising the acoustic energy produced by the autotransformer 304/piezoelectric transducer 306 combination and the acoustic cavity. The acoustic cavity may also be tuned to the desired frequency range, as described above.

The circuit schematic of FIG. 13*a* illustrates an alarm circuit without a base transistor. With a direct drive from the microcontroller 301, the output signal is clipped. This introduces frequency components at 3×, 5×, etc. times the fundamental frequency and disperses the energy into these frequencies. Because the acoustic cavity is tuned to the fundamental range (about 2.5 kHz to about 5 kHz) the energy at the higher frequencies is partially wasted. The human ear is less sensitive at these higher frequencies. The resulting perceived audible volume is diminished.

Referring to FIG. 13*b*, in accordance with an embodiment of the present disclosure, a base resistor 314 is provided in series between the base of the driving transistor 303 and the alarm switches 302 illustrated in FIG. 12. The inclusion of the base resistor 314 allows the output signal to go below the 0V reference level. The reactive signal is allowed to relax more and resonance is possible. This results in a higher voltage swing on the piezoelectric transducer 306 Also, the higher frequency components are diminished and much more of the signal power is concentrated within the acoustic cavity resonant frequency range. This, in turn, results in a more audible signal being produced in the human sensitivity range. The resulting perceived audible volume is increased and is more pure and piercing. Without such a resistor, the drive scheme does not allow the output signal to swing below the 0V reference level and so nearly half of the electrical energy is lost. Furthermore, much of the acoustic energy is produced outside of the most sensitive range of the human ear and is perceived as lower volume even though a sound pressure meter will indicate a higher volume because it is not as sensitive to the 2.5 kHz to 5 kHz range as the human ear. In contrast, the circuit design of the present disclosure allows a more complete resonance of the electrical signal, and therefore the mechanical movement of the piezoelectric transducer 306 and thus the acoustic sound. The addition of a simple resistor allows the electrical system to resonate more freely and so it produces more acoustic energy in the most sensitive audible range of about 2.5 kHz to about 5 kHz. By including a base resistor 314, the voltage across the autotransformer 304/piezoelectric transducer 306 combination is allowed a more natural sinusoidal swing and most of the energy is conserved during this cycle. The result is a higher voltage across the piezoelectric transducer 306, and thus a larger mechanical movement of air in the acoustic chamber, as well as confining more of the electrical and acoustic energy within the 2.5 kHz to 5 kHz band.

FIG. 14 is a graph illustrating the resulting output signals of the alarm circuits of FIGS. 13*a* and 13*b*. FIGS. 15*a* and 15 illustrate a spectral representation of effects of the base resistor with respect to the alarm circuits of FIGS. 13*a* and 13*b*.

Referring to FIG. 13*a*, without a base resistor, the specifications of the circuit may be as follows:

Vbe~0.7V

Rbe~1 kΩ

Ibe~3 mA (max current from microcontroller)

Ice (max)~hfe×3 mA=900 mA

Ice=Vbatt/180Ω=20 mA

Problem is current draw from microcontroller & transformer saturation.

Referring to FIG. 13*b*, with a base resistor, in one embodiment, the specifications of the circuit may be as follows:

Vbe~0.7V

Resistance of base resistor 314=1500 Ω

Ibe=(1.8−0.7)/1500=0.73 mA

Ice (max)~hfe×0.73 mA=220 mA

Ice=Vbatt/180Ω=20 mA

Less transformer saturation and microcontroller drive reduced.

As mentioned above, and referring to FIG. 12, the device may include a motion sensor such as an accelerometer 312 for monitoring steps, distance, sleep habits, etc. In this manner, the device of the present disclosure may be configured to offer both safety and fitness functionality.

The status of the device may be visually indicated using the coloured status LEDs 307. The conditions may include (but are not limited to) "Alarm condition", "Communicating with Bluetooth® device", "SOS warning", "Battery low" and "Charging".

Charging the device may be undertaken by connecting to a USB charger or computer using the USB connector 308. The USB supply may be conditioned using the charge controller 309 such that charge is supplied to the lithium-ion rechargeable battery 310 until the charge controller 309 detects a full charge. Then the charge controller 309 may be configured to switch to a trickle charge mode as defined by the device specification.

The microcontroller 301 may be powered from the lithium-ion battery 310 through the step-down DC-DC converter 311 to provide a low-power mode to the microcontroller 301.

The personal safety device of the present disclosure comprises an alarm circuit driving a piezoelectric transducer mounted in the acoustic chamber. Both the alarm circuit and the acoustic chamber may be tuned and matched in order to optimise the output sound level in the desired frequency range. The sound alarm is amplified in the acoustic chamber which also serves as the alarm actuating member. The overall shape and dimensions of the acoustic chamber form part of the resonant circuit that allows the device to generate the high sound pressure levels in the desired frequency region.

The words comprises/comprising when used in this specification are to specify the presence of stated features, integers, steps or components but does not preclude the presence or addition of one or more other features, integers, steps, components or groups thereof.

The invention claimed is:

1. A personal safety device configured to be attached to, worn by, or carried by a user, comprising:

an audible alarm mechanism configured to be selectively activated;

a manually activated actuating member for selectively activating the audible alarm mechanism; and an acoustic chamber defining an acoustic cavity for amplifying the audible alarm; wherein the acoustic chamber is housed in the actuating member, wherein the alarm mechanism and the acoustic cavity are configured to have the same resonant frequency, wherein the alarm mechanism comprises an alarm circuit and an audio transducer, wherein the alarm circuit is configured to drive the audio transducer, and wherein the alarm circuit further comprises an autotransformer configured to boost a signal output by the alarm circuit.

2. The device of claim 1, wherein the actuating member comprises a switch actuator for activating the alarm mechanism.

3. The device of claim 2, wherein the switch actuator comprises one or more trigger contacts protruding from a sidewall of the alarm actuating member.

4. The device of claim 1, comprising a housing, wherein the housing comprises a top housing section and a bottom housing section configured for attachment to each other, the top housing section comprising the actuating member.

5. The device of claim 4, wherein the top housing section comprises a main top housing section and the actuating member, the actuating member being moveable relative to the main top housing section.

6. The device of claim 5, wherein the actuating member is configured to be depressed into the main top housing section to activate the alarm mechanism.

7. The device of claim 1, wherein the actuating member is biased to an alarm OFF condition.

8. The device of claim 1, wherein the actuating member is manually actuatable to an alarm ON condition.

9. The device of claim 8, wherein the actuating member is hinged with a main top housing section.

10. The device of claim 1, wherein the audio transducer is mounted within the acoustic chamber.

11. The device of claim 1, wherein the audio transducer comprises a piezoelectric transducer.

12. The device of claim 11, wherein the piezoelectric transducer is disk-shaped.

13. The device of claim 11, wherein the arrangement of the piezoelectric transducer mounted within the acoustic chamber and sidewalls and a roof of the acoustic chamber together define an acoustic cavity.

14. The device of claim 13, wherein the acoustic cavity has a cylindrical shape.

15. The device of claim 13, wherein the piezoelectric transducer is provided at a base of the acoustic chamber, the piezoelectric transducer being configured to seal the acoustic cavity.

16. The device of claim 13, wherein the acoustic cavity is configured to produce a resonant frequency in a range of about 2.5 kHz to about 5 kHz.

17. The device of claim 1, further comprising a sound output aperture defined in a central portion of a roof of the alarm actuating member.

18. The device of claim 1, wherein the combination of the audio transducer and the autotransformer is configured to resonate at a frequency in a range of about 2.5 kHz to about 5 kHz.

19. The device of claim 1, wherein the combination of the audio transducer and the autotransformer is configured to have the same resonant frequency as that of the acoustic cavity.

20. The device of claim 1, wherein the alarm circuit comprises a driving transistor for switching current through the autotransformer which is amplified and applied to the piezoelectric transducer.

21. The device of claim 20, wherein the alarm circuit comprises a base resistor provided in series between the base of the driving transistor and a current source.

22. The device of claim 1, wherein the alarm actuating member has a cylindrical shape.

23. The device of claim 1, being configured to produce an audible alarm sound in the range of about 120 dB to about 130 dB.

24. The device of claim 1, comprising an on/off switch for deactivating the alarm circuit.

25. The device of claim 1, wherein the alarm mechanism is configured to be activated or deactivated remotely from a mobile application.

26. The device of claim 1, being configured to be worn within a wristband or body clasp.

27. The device of claim 1, being configured for communication to a mobile device and/or the Internet.

28. The device of claim 1, comprising a motion sensor.

29. The device of claim 28, wherein the motion sensor comprises an accelerometer.

* * * * *